United States Patent [19]

Matsuzawa

[11] 4,013,132

[45] Mar. 22, 1977

[54] DEVICE FOR SUPPORTING BULLDOZER BLADE

[75] Inventor: Kunihiko Matsuzawa, Sagamihara, Japan

[73] Assignee: Mitsubishi Jukogyo Kabushiki Kaisha, Tokyo, Japan

[22] Filed: Dec. 30, 1975

[21] Appl. No.: 645,453

[30] Foreign Application Priority Data

Jan. 6, 1975 Japan ..... 50-18
July 21, 1975 Japan ..... 50-88413

[52] U.S. Cl. ..... 172/804; 172/807
[51] Int. Cl.[2] ..... E02F 3/76
[58] Field of Search ..... 172/804, 801, 802, 803, 172/805, 806, 807, 808, 809

[56] References Cited

UNITED STATES PATENTS

| | | | |
|---|---|---|---|
| 2,224,725 | 12/1940 | Felt | 172/804 |
| 2,950,550 | 8/1960 | French | 172/804 |
| 3,648,782 | 3/1972 | Mazzarins | 172/804 |
| 3,822,751 | 7/1974 | Waterman | 172/804 X |

*Primary Examiner*—George J. Marlo
*Attorney, Agent, or Firm*—Cushman, Darby & Cushman

[57] ABSTRACT

A device for supporting a bulldozer blade comprising a frame, a subframe pivotally connected to the frame for limited relative movement about a vertical axis, first hydraulic cylinder means for rotating the subframe about the vertical axis, a blade provided in front of the subframe, a universal joint connecting one side of the subframe to one side of the blade, a pair of links connecting the other side of the subframe to the other side of the blade through spherical joints and a second hydraulic cylinder means for the rotation of the blade about the universal joint substantially in a vertical plane.

The construction permits the blade to be held firmly while the smooth tilting of the blade is insured.

4 Claims, 14 Drawing Figures

FIG. 12
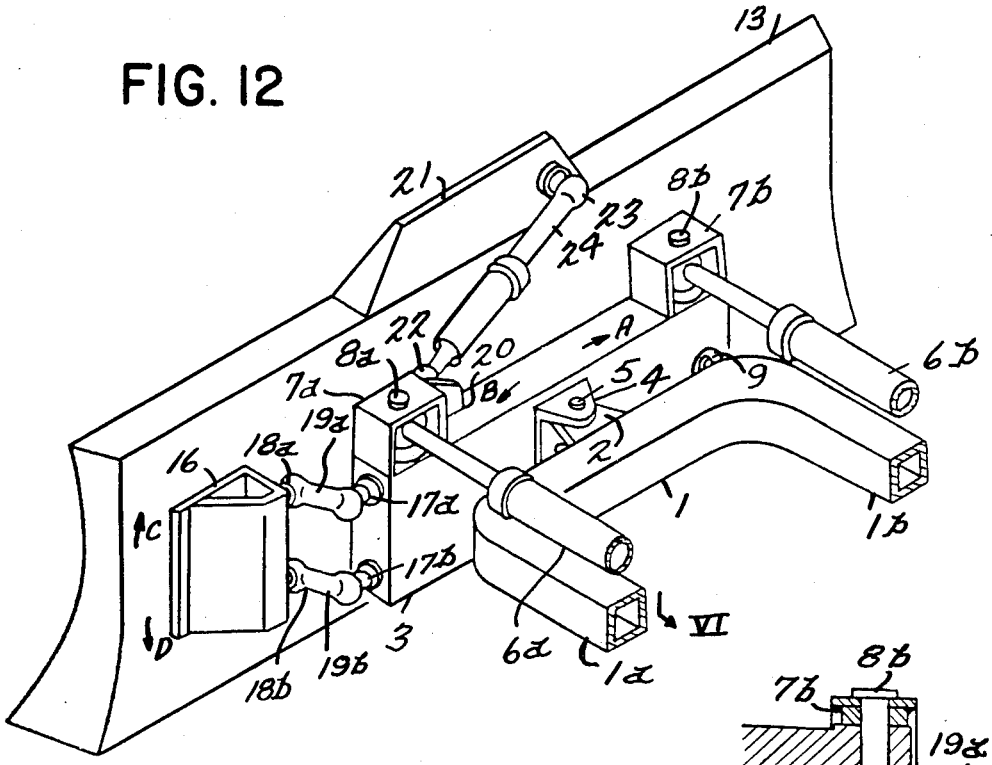
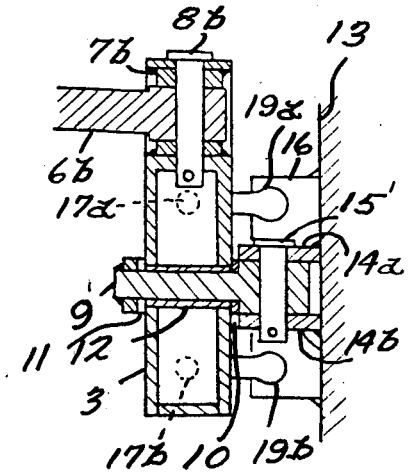
FIG. 13
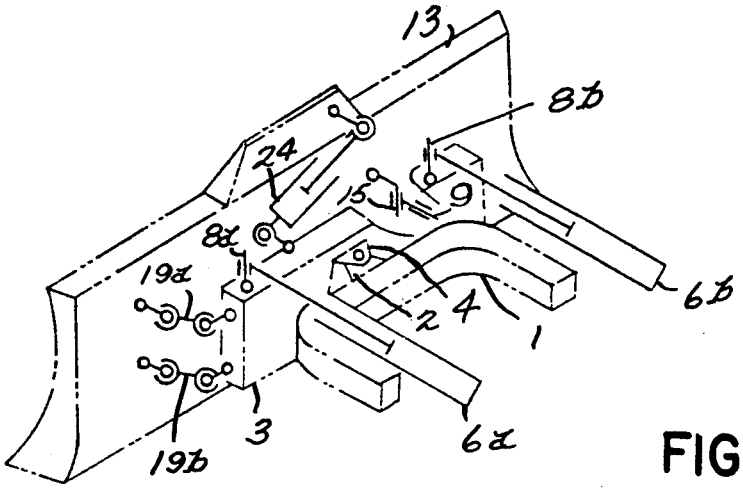
FIG. 14

DEVICE FOR SUPPORTING BULLDOZER BLADE

BACKGROUND OF THE INVENTION

1. Field of the Invention

This invention relates to a device for supporting the blade of a bulldozer and the like.

2. Prior Art

Prior art bulldozer blade supporting devices are very complicated in construction and require very high accuracy in assembling the various components of the devices resulting in very high manufacturing cost.

This invention aims at avoiding the above described disadvantages of prior art bulldozer blade supporting devices.

SUMMARY OF THE INVENTION

The object of this invention is to provide a novel and useful device for supporting the bulldozer blade which avoids the above described disadvantages of the prior art bulldozer blade supporting devices.

Another object is to provide a bulldozer blade supporting device which is simple in construction and insures smooth operation of the blade.

The above objects are achieved in accordance with this invention by the provision of a bulldozer blade supporting device comprising a frame, a subframe pivotally connected to the frame for limited relative movement about a vertical axis, first hydraulic cylinder means for rotating the subframe about the vertical axis, a blade provided in front of the subframe, a universal joint connecting one side of the subframe to one side of the blade, a pair of links connecting the upper and lower portions of the other side of the subframe to the upper and lower portions of the other side of the blade through spherical joints, and a second hydraulic cylinder means for rotating the blade about the universal joint substantially in a vertical plane.

With this arrangement, the device is made simple in construction and the blade can be firmly held to the subframe and hence to the frame while the smooth tilting operation of the blade is insured.

BRIEF DESCRIPTION OF THE DRAWINGS

FIG. 12 is a perspective view showing another embodiment of the blade supporting device of this invention;

FIG. 13 is a fragmentary cross-sectional view along line 13—13 in FIG. 12; and FIG. 14 is a schematic perspective view showing the various forces applied to the embodiment illustrated in FIG. 12.

DETAILED DESCRIPTION OF THE PREFERRED EMBODIMENTS

Figure 1:
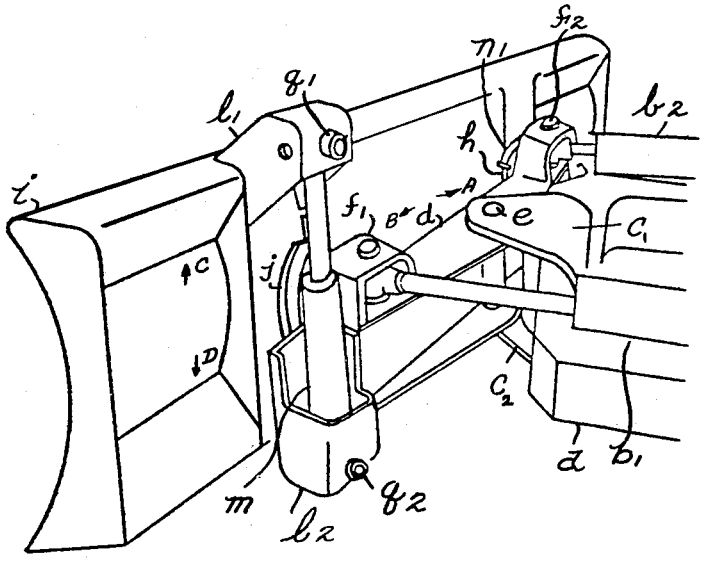
FIG. 1 is a perspective view showing a prior art bulldozer blade supporting device.
Figure 2:
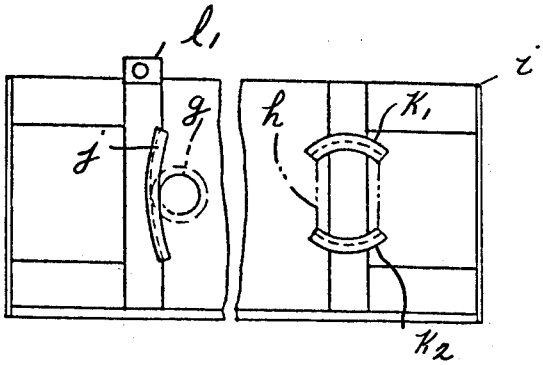
FIG. 2 is a rear elevational view showing the blade of FIG. 1.
Figure 3:
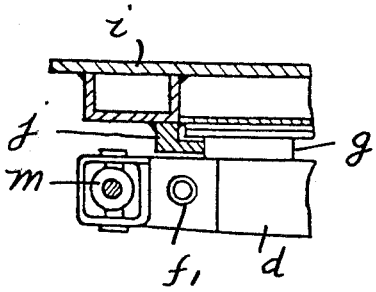
FIG. 3 is a fragmentary horizontal cross-sectional view of a portion of the device of FIG. 1.

Referring now to FIGS. 1 to 3 showing a prior art blade supporting device, *a* designates a supporting beam attached to the bulldozer body (not shown); $b_1$ and $b_2$ are hydraulic cylinder means mounted on both sides of the supporting beam *a*; $c_1$ and $c_2$ being brackets attached to the center of the supporting beam *a*; *d* being a frame; *e* being a pin swingably mounting the center of the frame *d* on the brackets $c_1$ and $c_2$; $f_1$ being a pin for connecting the tip of the piston rod of the hydraulic cylinder system $b_1$ to the left hand end of the frame *d*; $f_2$ being a pin for connecting the tip of the piston rod of the hydraulic cylinder system $b_2$ to the right hand end of the frame *d*. In FIG. 2, *g* designates a circular disc-like plate fixedly secured to the front face of the left hand end of the frame *d*. In FIGS. 1 and 2, *h* designates a plate having upper and lower circular arcuate end portions and parallel side portions, which is fixedly secured to the front face of the right hand end of the frame *d*. In FIGS. 1, 2 and 3, *i* designates a blade; *j* designates an arcuate guide rail secured to the rear surface of the left hand end of the blade *i* for embracing and guiding the plate *g* from one side thereof. In FIGS. 1 and 2, $k_1$ and $k_2$ designate a pair of arcuate guide rails secured symmetrically opposite each other to the rear surface of the right hand end of the blade *i* for embracing and guiding the plate *h* from the upper and lower arcuate sides thereof; $l_1$ being a bracket secured to the upper surface of the left hand end of the blade *i*; $l_2$ being a bracket secured to the left hand end of the frame *d*; *m* being a hydraulic cylinder means; $q_1$ being a pin connecting the tip of the piston rod of the cylinder means *m* to the bracket $l_1$; $q_2$ being a pin pivotally connecting the lower end of the cylinder means *m* to the bracket $l_2$.

When the cylinder means $b_1$ is extended, the frame *d* and the blade *i* are rotated in the direction of the arrow A, clockwise about the pin *e*. When the cylinder means $b_2$ is extended, the frame *d* and the blade *i* are rotated in the direction of the arrow B, counterclockwise about the pin *e*. Further, when the cylinder system *m* is extended, the blade *i* is tilted upward in the direction of the arrow *c*, clockwise about the plate *h*, while, when the cylinder system *m* is contracted, the blade *i* is tilted downward in the direction of the arrow D, counterclockwise about the plate *h*.

The blade supporting device described above is so arranged that the plates *g* and *h* are provided in the frame *d* at the bulldozer body side; the guide rail *j* and guide rails $k_1$ and $k_2$ are provided in the blade *i* so that the blade *i* is made tiltable. This construction is very complicated and requires a very high accuracy in dimensions for manufacturing the various components and in the assembly thereof, which results in correspondingly high manufacturing costs. Further, since the guide rails *j*, $k_1$ and $k_2$ are exposed, they often become caked with mud during use, causing the tilting of the blade to be unsmooth. The guide rail *j* and the plate *g* as well as guide rails $k_1$ and $k_2$ and the plate *h* are, respectively, engaged with each other at a portion thereof, and therefore, when undue force is applied thereto, through the frame *d*, the device might be broken. Further, it is necessary to provide a clearance between the guide rails *j*, $k_1$ and $k_2$, and the frame *d*, thereby causing undue play between the components so that the working efficiency is lowered.

In order to avoid the disadvantages of the above-described prior art blade supporting device, this invention provides a blade supporting device characterized by a frame, a subframe pivotally connected to the frame for limited relative movement about a vertical axis, first hydraulic cylinder means for rotating the subframe about the vertical axis, a blade provided in front of the subframe, a universal joint connecting one side of the subframe to one side of the blade, a pair of links connecting the upper and lower portions of the other side of the subframe through spherical joints to the upper and lower portions of the other side of the blade, a second hydraulic cylinder means for rotating the blade about the universal joint substantially in a vertical plane. The blade, with this arrangement, can be supported firmly and tilted smoothly.

Since one side of the subframe which is pivotally supported by the frame, is connected to one side of the blade through the universal joint and the upper and lower portions of the other side of the subframe are connected through the spherical joints and a pair of links to the upper and lower portions of the other side of the blade, the blade is supported firmly and in a stable state in any position. Further, when the second hydraulic cylinder means provided between the subframe and the blade is extended or contracted, the blade can be tilted substantially vertically about the universal joint. In this case, the links follow this movement so that they are rotated from their initial horizontal positions in an arcuate path about the spherical joints, i.e., in the obliquely rearward and upward direction or in the obliquely rearward and downward direction, and the other side of the blade follows and rotates about the universal joint thereby permitting the blade to be tilted. The rotation of the blade about the universal joint is caused by the fact that the links are rotated in the above described direction. Thus, when the second cylinder means is extended or contracted, the blade is tilted substantially vertically about a horizontal axis. Therefore, the tilting of the blade can be made smooth. Since the force applied to the blade is transmitted to the subframe through the pair of links, the spherical joints, the second cylinder means and the universal joint, the construction is made simple and yet strong.

Now reference is made to FIGS. 4 to 7 showing a first preferred embodiment of the present invention.

Figure 4:
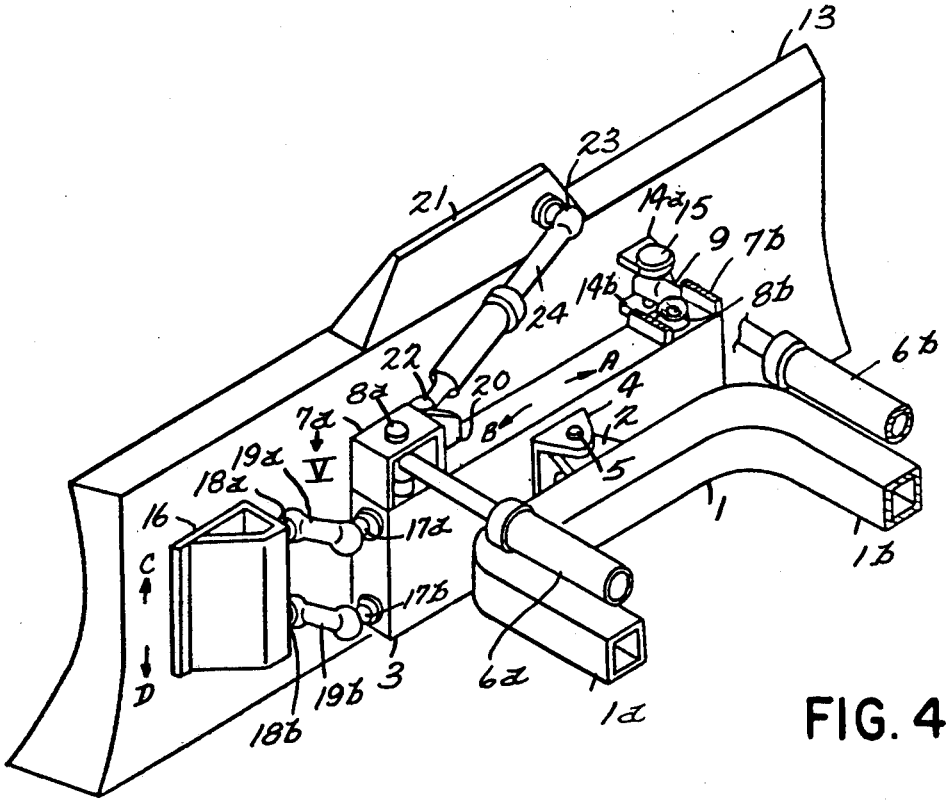
FIG. 4 is a perspective view showing a first embodiment of the bulldozer blade supporting device constructed in accordance with the present invention.
Figure 5:
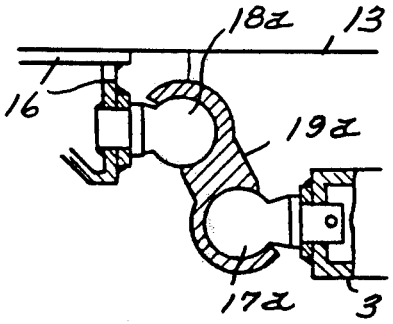
FIG. 5 is a cross-sectional view along line 5—5 in FIG. 4.
Figure 6:
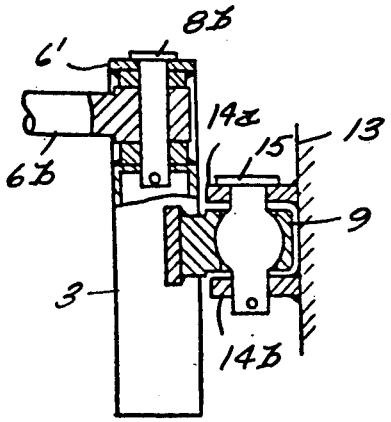
FIG. 6 is a fragmentary cross-sectional view along line 6—6 in FIG. 4.
Figure 7:
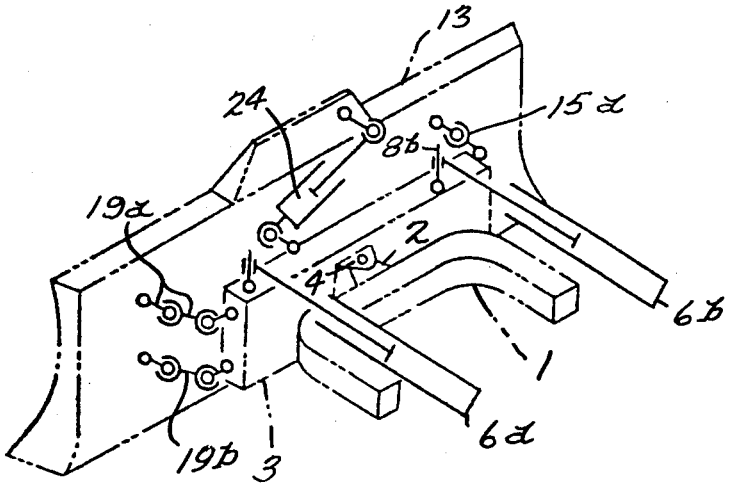
FIG. 7 is a schematic perspective view showing the various forces applied to the first embodiment of the present invention.

In FIGS. 4 and 7 the supporting beam 1 is attached to a bulldozer body (not shown) and a bracket 2 is attached to the supporting beam 1 at the center thereof. In FIGS. 4 to 7, a subframe 3 is shown with a bracket 4 attached to the rear face of the subframe at the center thereof. A pin 5 pivotally connects the bracket 2 to the bracket 4 and first hydraulic cylinder means are mounted on the left side 1*a* and the right side 1*b*, respectively, of the supporting beam 1. Brackets 7*a* and 7*b* are attached to the left hand upper surface and the right hand upper surface of the subframe 3, respectively, and pins 8*a* and 8*b* pivotally connect tips of piston rods of the cylinder means 6*a* and 6*b* to the brackets 7*a* and 7*b* respectively. A block 9 is welded to the right side of the subframe 3 and a shaft 15 having a spherical portion is provided in the block 9 which has a corresponding spherical groove formed therein. Plates 14*a* and 14*b* are welded to the right hand side of the blade 13 and pivotally support the ends of the shaft 15.

In this embodiment the universal joint previously described, comprises the block 9, the plates 14*a* and 14*b* and the shaft 15. A bracket 16 is secured to the rear surface of the left hand of the blade 13 and spherical joints 17*a* and 17*b* are mounted on the upper and lower portions of the left hand side of the subframe 3. Spherical joints 18*a* and 18*b* are mounted on the upper and lower portions of the side surface of bracket 16 and links 19*a* and 19*b* are connected between the spherical joints 17*a* and 17*b* and the spherical joints 18*a* and 18*b*, respectively.

In FIG. 4, a bracket 20 is attached to the subframe 3 adjacent the bracket 7*a* and a plate 21 is attached to the upper surface of the blade 13 at the center thereof. A spherical joint 22 is attached to the bracket 20 and a spherical joint 23 is attached to the plate 21. A second hydraulic cylinder means 24 is connected between the spherical joints 22 and 23.

The operation of the blade supporting device described above will now be described.

First, a description will be given of the rotation of the blade 13 about the pin 5 in the direction of arrows A and B in FIG. 4.

Figure 8:
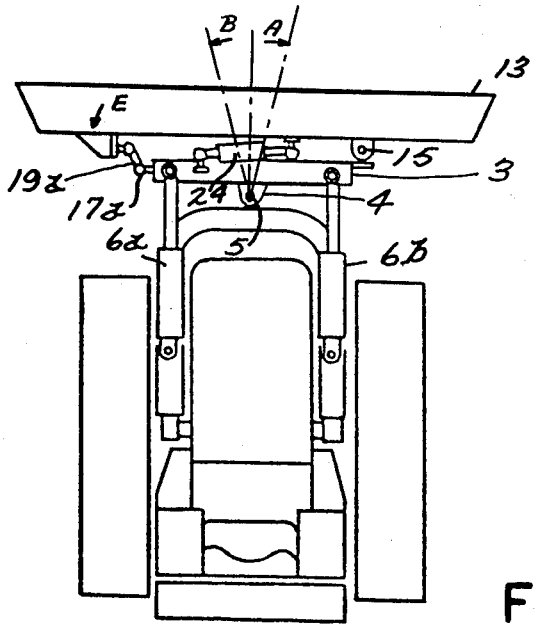
FIGS. 8 and 9 are plan views showing the manner of movement of the blade of the first embodiment of the present invention.
Figure 9:
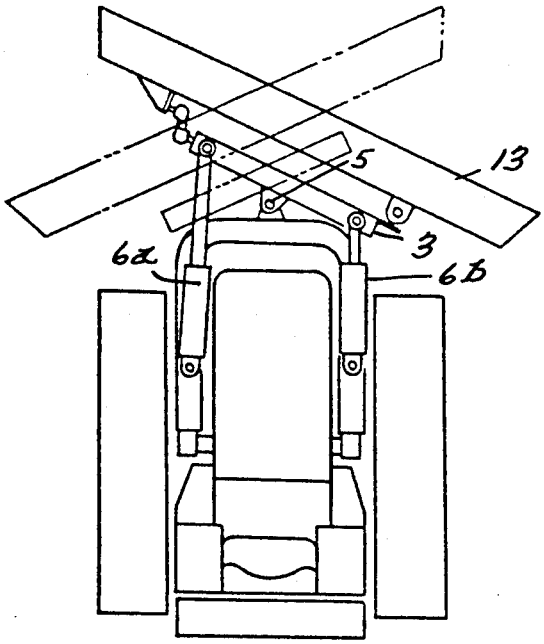

When the first cylinder means 6*a* is extended from the position shown in FIG. 8 by switching a switching valve (not shown) provided in the bulldozer body, the subframe 3 and the blade 13 are rotated in the direction A, clockwise about the pin 5, so as to assume the position shown by solid lines in FIG. 9. When the first cylinder means 6*a* is contracted from the position shown in FIG. 8 by again switching the switching valve, the subframe 3 and the blade 13 are rotated in the direction B, counterclockwise about the pin 5, so as to assume the position shown in phantom in FIG. 9.

Figure 10:
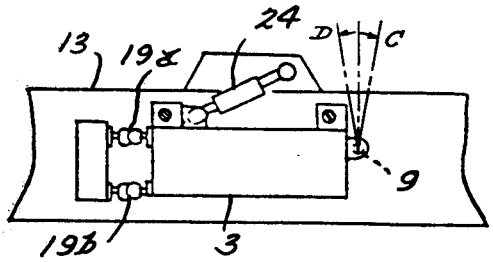
FIGS. 10 and 11 are rear elevational views showing the manner of movement of the blade of the first embodiment of the present invention.

Next a description will be provided of the tilting movement of the blade 13 about the universal joint (composed of block 9, plates 14*a* and 14*b*, and shaft 15) in the direction of arrows C or D in FIGS. 4 and 10.

Figure 11:
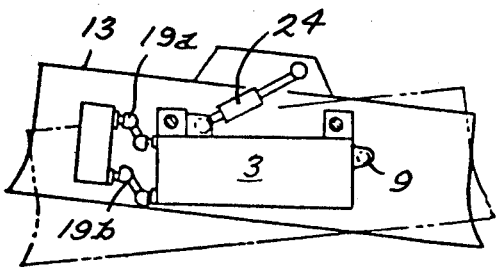

When the second cylinder means 24 is extended from the position shown in FIG. 10 by switching a switching valve (not shown), the blade 13 is tilted in the direction of arrow C about the universal joint so as to assume the position shown by solid lines in FIG. 11. In other words, the left hand side of the blade 13 is raised. In this case, the links 19*a* and 19*b* connecting the left hand side of the blade 13 to the left hand side of the subframe 3 are rotated in an arcuate path about the spherical joints 17*a* and 17*b*, i.e. in the obliquely rearward and upward direction, and, at the same time, the blade 13 is rotated in the direction of arrow E, shown in FIG. 8, about the pin 15 so that the blade 13 is permitted to effect the above described tilting movement.

When the second cylinder means 24 is contracted from the position shown in FIG. 10 by operating the switching valve, the blade 13 is tilted in the direction of arrow D about the universal joint so as to assume the position shown in phantom in FIG. 11. In other words, the left hand side of the blade 13 is lowered. In this case, the links 19*a* and 19*b* are rotated in the arcuate path about the spherical joints 17*a* and 17*b*, i.e., in the obliquely rearward and downward direction, and, at the same time, the blade 13 is rotated in the direction of arrow E, shown in FIG. 8, about the pin 15 so that the tilting of the blade 13 is effected.

When the second cylinder means 24 is locked after it has been either extended, contracted or returned to its neutral position, the blade 13 is securely fixed to the subframe 3 maintaining its given position by means of the links 19*a* and 19*b*, the universal joint (comprising block 9, plates 14*a* and 14*b*, and shaft 15) and the second hydraulic cylinder means 24.

Now, another embodiment of this invention will be described with reference to FIGS. 12 to 14.

This embodiment is substantially similar to that shown in FIGS. 4 to 11 except that the universal joint is replaced by the universal joint as shown in FIG. 13 which comprises a block 9' extending through the right hand end of the subframe 3, washers 10 and 11 and a bushing 12 rotatably supporting the block 9' to the right hand end of the subframe 3, a shaft 15' rotatably fitted in the block 9' and the right hand side of the blade 13, and plates 14*a* and 14*b* welded to the blade 13 and supporting the shaft 15' fitted therein.

With the construction of this embodiment shown in FIGS. 12 to 14, the rotation of the blade 13 in the direction of arrows A or B as shown in FIG. 12, about the pin 5 as well as the tilting of the blade 13 in the direction of arrows C or D about the universal joint (comprising block 9', washers 10 and 11, bushing 12, plates 14*a* and 14*b* and shaft 15') is effected in the same manner as described in connection with the embodiment shown in FIGS. 4 to 11.

When the second cylinder means 24 is locked after the given operation thereof, the blade 13 is securely fixed in position with respect to the subframe 3 by means of the links 19*a* and 19*b*, the universal joint, and the second cylinder means 24.

Although the foregoing description illustrates the preferred embodiment of the present invention, it will be apparent to those skilled in the art that variations are possible. All such variations as would be obvious to those skilled in this art are intended to be included within the scope of this invention as defined by the following claims.

What is claimed is:

1. A device for supporting a blade on a bulldozer, comprising:

a subframe adapted to be supported by a frame of the bulldozer for limited pivotal movement relative to the frame, about a vertical axis;

first hydraulic cylinder means securable to the bulldozer and secured to the subframe for causing said pivotal movement of the subframe;

a blade disposed in front of the subframe;

universal joint means connecting one side of the subframe to one side of the blade;

a pair of linking means each having spherical joints on each end thereof, one of the linking means connecting an upper portion of another end of the subframe to an upper portion of another end of the blade and the other of the linking means connecting a lower portion of the other end of the subframe to a lower portion of the other end of the blade, for permitting limited movement of the blade relative to the subframe; and second hydraulic cylinder means connected to the subframe and the blade for causing the blade to move substantially in the vertical direction pivotally about the universal joint means.

2. A device as defined in claim 1 wherein the first hydraulic cylinder means further comprises:

a pair of hydraulic cylinders pivotally secured at one end of each thereof to opposite sides of the subframe and adapted to be secured to the bulldozer for pivotal movement, so as to move the subframe and the blade about said vertical axis.

3. A device as defined in claim 1 wherein the universal joint means further comprises:

a shaft having cylindrical end portions and a spherical central portion;

a block having a hollow spherical portion defined therein surrounding the central portion of the shaft and mating therewith so as to permit limited relative movement therebetween in any direction, and openings through which the cylindrical end portions of the shaft extend, the block being secured to the subframe;

brackets secured to the blade and supporting the shaft about the cylindrical end portions thereof.

4. A device as defined in claim 1 wherein the second hydraulic cylinder means further comprises:

a hydraulic cylinder having one end pivotally secured to the subframe at the upper portion of the other side thereof and the other end secured to the blade on said one side above the universal joint means so as to cause rotation of the blade about the universal joint means in a substantially vertical arcuate path defined by corresponding movement of the linking means.

* * * * *